US006482043B1

(12) United States Patent
Stout

(10) Patent No.: US 6,482,043 B1
(45) Date of Patent: Nov. 19, 2002

(54) ELECTRICAL WALL OUTLET ASSEMBLY

(76) Inventor: Orlene Stout, P.O. Box # 527, Decatur, TN (US) 37322

( * ) Notice: Subject to any disclaimer, the term of this patent is extended or adjusted under 35 U.S.C. 154(b) by 0 days.

(21) Appl. No.: 09/931,801

(22) Filed: Aug. 17, 2001

(51) Int. Cl.[7] ..... H01R 25/00
(52) U.S. Cl. ..... 439/652
(58) Field of Search ..... 439/535, 652, 439/650, 651, 447

(56) References Cited

U.S. PATENT DOCUMENTS

| | | | | | |
|---|---|---|---|---|---|
| 2,436,753 | A | * | 2/1948 | Kuhn et al. | 174/65 R |
| 2,702,893 | A | | 2/1955 | Paulson | |
| 3,609,647 | A | * | 9/1971 | Castellano | 174/53 |
| 3,714,616 | A | | 1/1973 | Sample | |
| 3,904,812 | A | * | 9/1975 | Daffron | 174/52.1 |
| D243,403 | S | | 2/1977 | Rellis | |
| 4,211,464 | A | * | 7/1980 | Lee | 174/53 |
| 4,530,556 | A | | 7/1985 | Bonus | |
| 4,767,359 | A | | 8/1988 | Martell | |
| 5,004,435 | A | | 4/1991 | Jammet | |
| D318,849 | S | | 8/1991 | Luu | |
| D370,460 | S | | 6/1996 | Boesel et al. | |

* cited by examiner

*Primary Examiner*—Neil Abrams
*Assistant Examiner*—Phuong K T Dinh

(57) ABSTRACT

An electrical wall outlet assembly for allowing the user to safely change worn out or damaged electrical outlets. The electrical wall outlet assembly includes a base outlet member including a housing having a front, back, and side walls, and also including cable jacks being disposed in at least one of the side walls thereof, and further having slots disposed through the front wall thereof; and also includes an electrical outlet adapter member including a housing member having a front, back, and side walls, and also having mounting brackets being attached to the housing member, and further having prongs extending outwardly from the back wall and being removably received in the slots of the base outlet member; and further includes at least one cable connector for connecting a cable to the cable jacks.

9 Claims, 3 Drawing Sheets

ELECTRICAL WALL OUTLET ASSEMBLY

BACKGROUND OF THE INVENTION

1. Field of the Invention

The present invention relates to electrical outlets and more particularly pertains to a new electrical wall outlet assembly for allowing the user to safely change worn out or damaged electrical outlets.

2. Description of the Prior Art

The use of electrical outlets is known in the prior art. More specifically, electrical outlets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 370,460; U.S. Pat. No. Des. 318,849; U.S. Pat. No. Des. 243,403; U.S. Pat. No. 3,714,616; U.S. Pat. No. 2,702,893; U.S. Pat. No. 4,530,556; U.S. Pat. No. 4,767,359; and U.S. Pat. No. 5,004,435.

While these devices fulfill their respective, particular objectives and requirements, the aforementioned patents do not disclose a new electrical wall outlet assembly. The inventive device includes a base outlet member including a housing having a front, back, and side walls, and also including cable jacks being disposed in at least one of the side walls thereof, and further having slots disposed through the front wall thereof; and also includes an electrical outlet adapter member including a housing member having a front, back, and side walls, and also having mounting brackets being attached to the housing member, and further having prongs extending outwardly from the back wall and being removably received in the slots of the base outlet member; and further includes at least one cable connector for connecting a cable to the cable jacks.

In these respects, the electrical wall outlet assembly according to the present invention substantially departs from the conventional concepts and designs of the prior art, and in so doing provides an apparatus primarily developed for the purpose of allowing the user to safely change worn out or damaged electrical outlets.

SUMMARY OF THE INVENTION

In view of the foregoing disadvantages inherent in the known types of electrical outlets now present in the prior art, the present invention provides a new electrical wall outlet assembly construction wherein the same can be utilized for allowing the user to safely change worn out or damaged electrical outlets.

The general purpose of the present invention, which will be described subsequently in greater detail, is to provide a new electrical wall outlet assembly which has many of the advantages of the electrical outlets mentioned heretofore and many novel features that result in a new electrical wall outlet assembly which is not anticipated, rendered obvious, suggested, or even implied by any of the prior art electrical outlets, either alone or in any combination thereof.

To attain this, the present invention generally comprises a base outlet member including a housing having a front, back, and side walls, and also including cable jacks being disposed in at least one of the side walls thereof, and further having slots disposed through the front wall thereof; and also includes an electrical outlet adapter member including a housing member having a front, back, and side walls, and also having mounting brackets being attached to the housing member, and further having prongs extending outwardly from the back wall and being removably received in the slots of the base outlet member; and further includes at least one cable connector for connecting a cable to the cable jacks.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electrical wall outlet assembly which has many of the advantages of the electrical outlets mentioned heretofore and many novel features that result in a new electrical wall outlet assembly which is not anticipated, rendered obvious, suggested, or even implied by any of the prior art electrical outlets, either alone or in any combination thereof.

It is another object of the present invention to provide a new electrical wall outlet assembly which may be easily and efficiently manufactured and marketed.

It is a further object of the present invention to provide a new electrical wall outlet assembly which is of a durable and reliable construction.

An even further object of the present invention is to provide a new electrical wall outlet assembly which is susceptible of a low cost of manufacture with regard to both materials and labor, and which accordingly is then susceptible of low prices of sale to the consuming public, thereby making such electrical wall outlet assembly economically available to the buying public.

Still yet another object of the present invention is to provide a new electrical wall outlet assembly which provides in the apparatuses and methods of the prior art some of the advantages thereof, while simultaneously overcoming some of the disadvantages normally associated therewith.

Still another object of the present invention is to provide a new electrical wall outlet assembly for allowing the user to safely change worn out or damaged electrical outlets.

Yet another object of the present invention is to provide a new electrical wall outlet assembly which includes a base outlet member including a housing having a front, back, and side walls, and also including cable jacks being disposed in at least one of the side walls thereof, and further having slots disposed through the front wall thereof; and also includes an electrical outlet adapter member including a housing member having a front, back, and side walls, and also having mounting brackets being attached to the housing member, and further having prongs extending outwardly from the back wall and being removably received in the slots of the base outlet member; and further includes at least one cable connector for connecting a cable to the cable jacks.

Still yet another object of the present invention is to provide a new electrical wall outlet assembly that is easy and convenient to install and use.

Even still another object of the present invention is to provide a new electrical wall outlet assembly that eliminates the user from having to disconnect the wires from the electrical outlet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
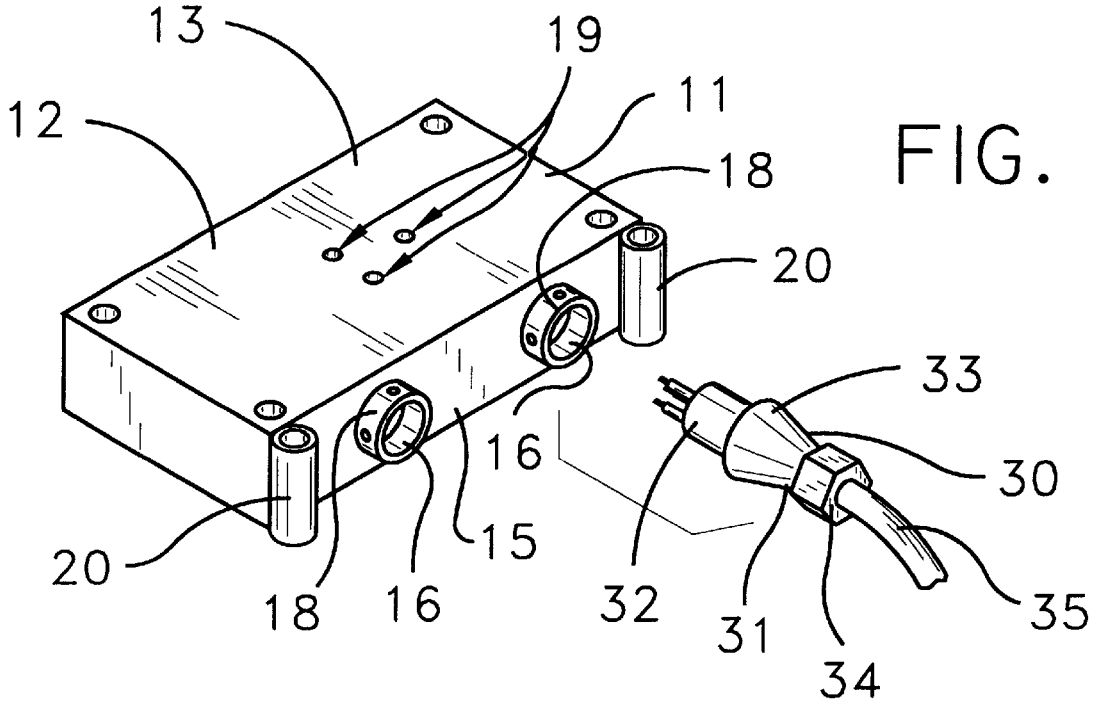
FIG. 1 is a perspective view of a base outlet member of a new electrical wall outlet assembly according to the present invention.
Figure 2:
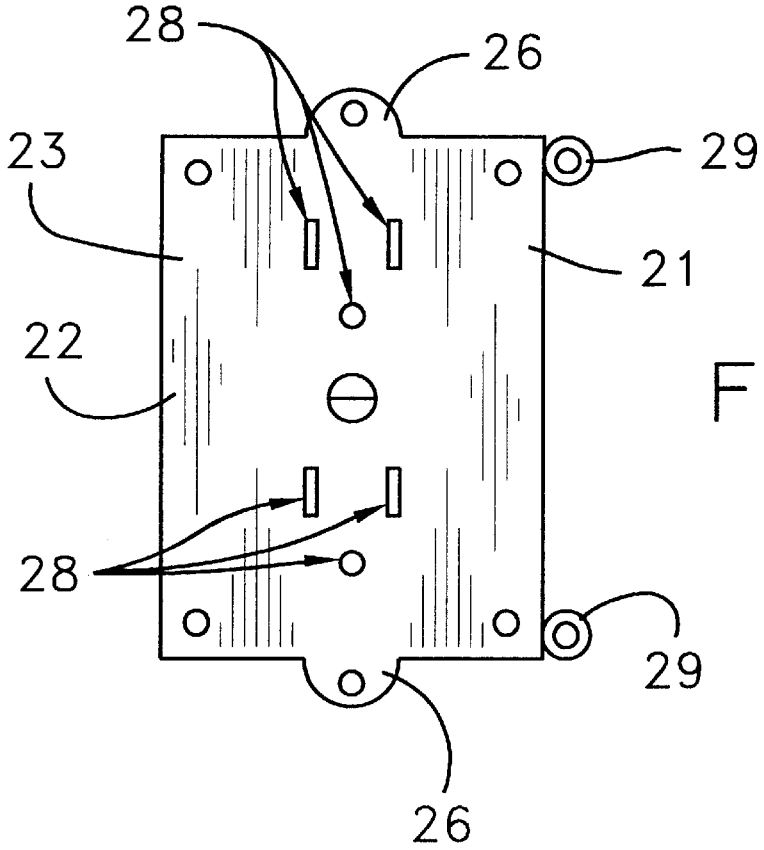
FIG. 2 is a front elevational view of the base outlet member of the present invention.
Figure 3:
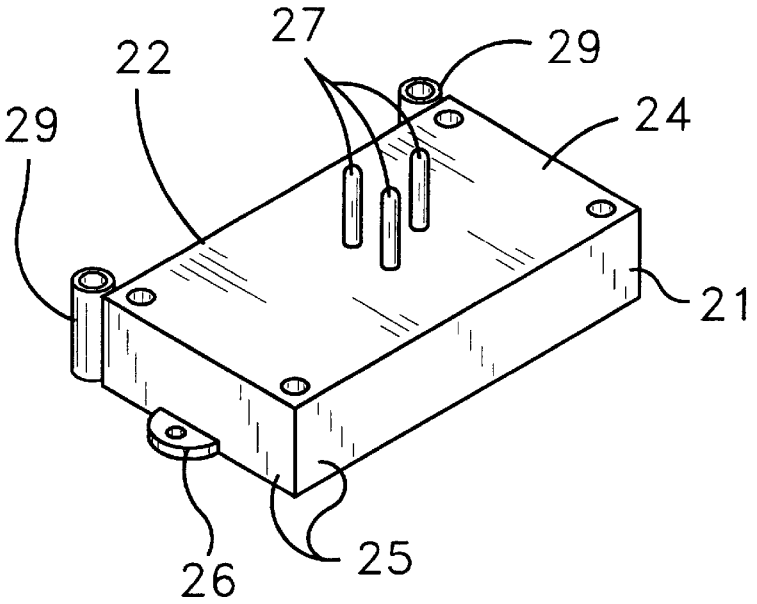
FIG. 3 is a back elevational view of the base outlet member of the present invention.
Figure 4:
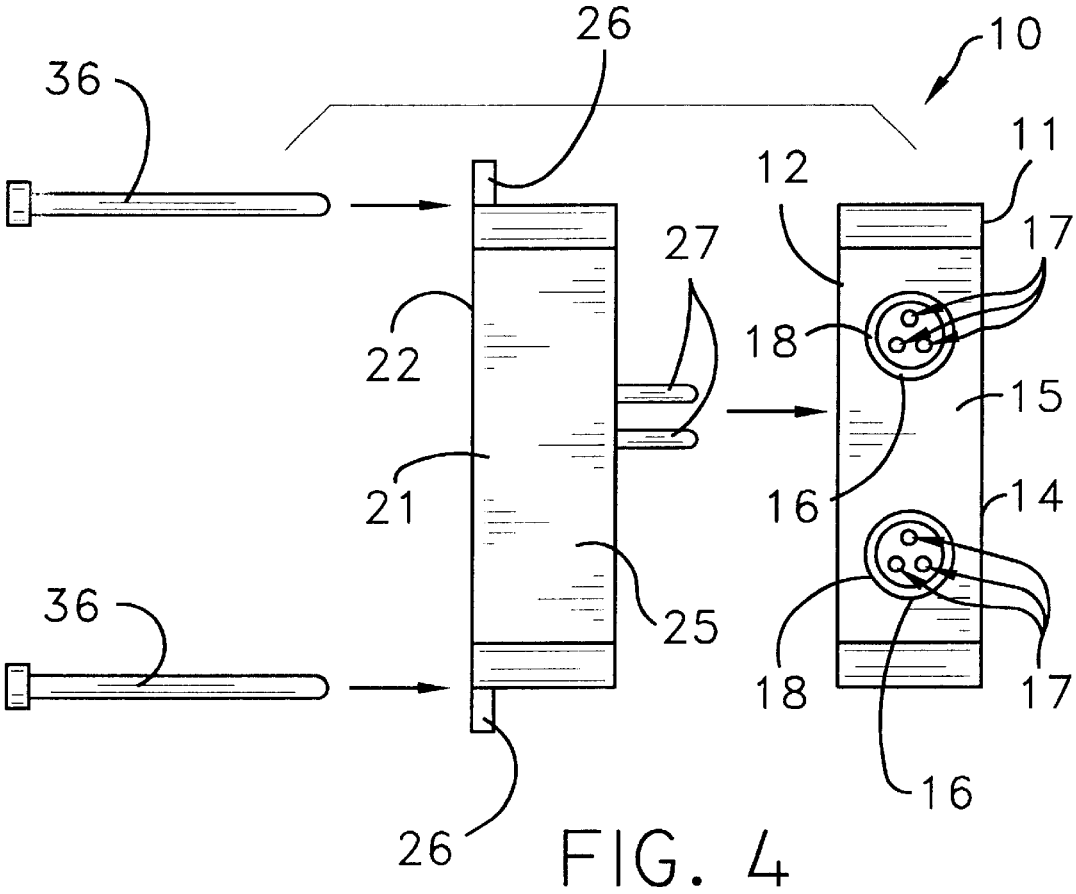
FIG. 4 is an exploded side elevational view of the present invention.
Figure 5:
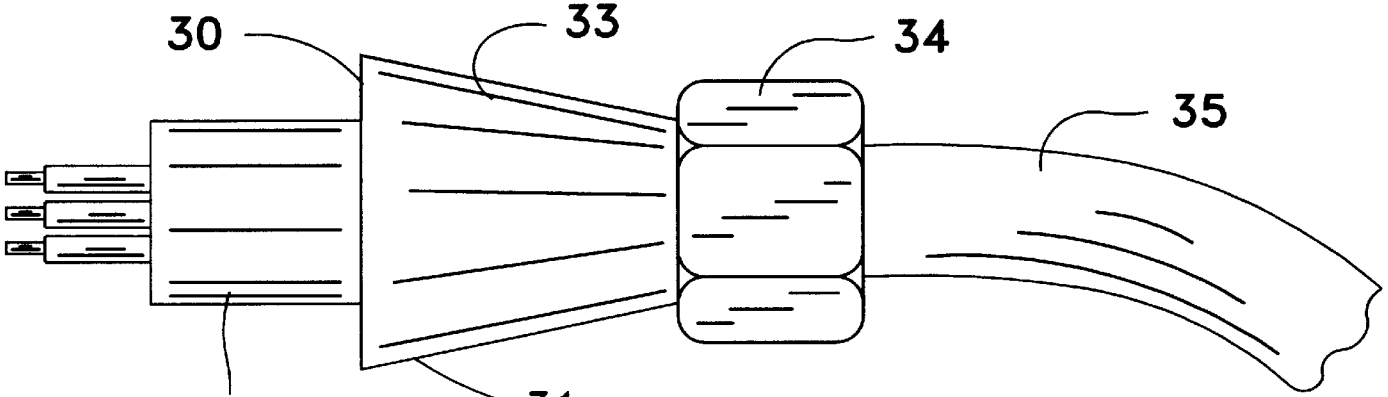
FIG. 5 is a side elevational view of a cable connector used with the present invention.
Figure 6:
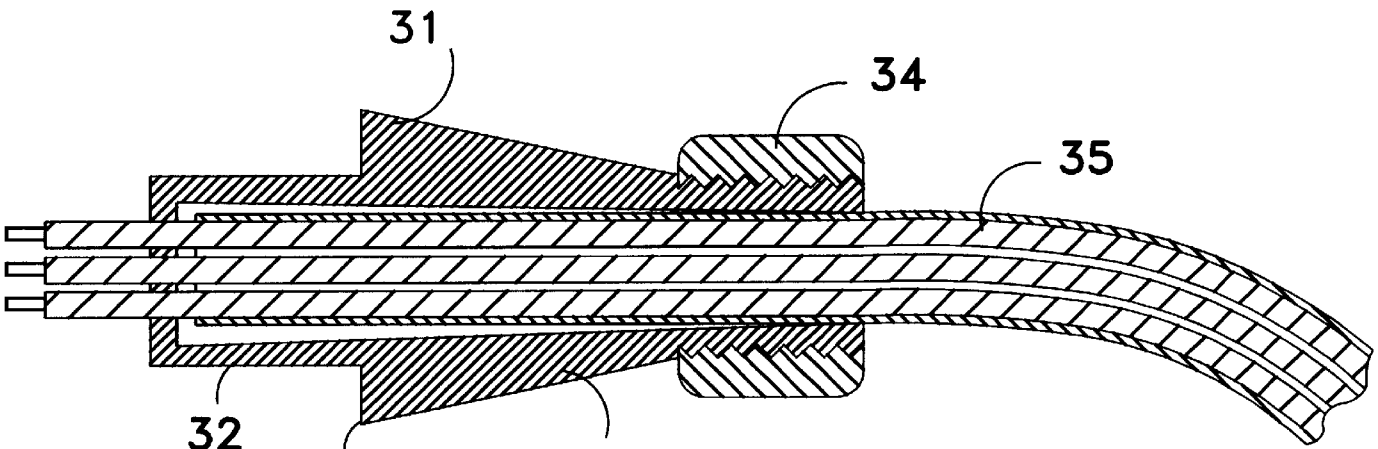
FIG. 6 is a cross-sectional view of the cable connector used with present invention.

With reference now to the drawings, and in particular to FIGS. 1 through 6 thereof, a new electrical wall outlet assembly embodying the principles and concepts of the present invention and generally designated by the reference numeral 10 will be described.

As best illustrated in FIGS. 1 through 6, the electrical wall outlet assembly 10 generally comprises a base outlet member 11 including a housing 12 having a front, back, and side walls 13–15, and also including cable jacks 16 being disposed in at least one of the side walls 15 thereof, and further having slots 19 being disposed through the front wall 13 thereof. The base outlet member 11 also includes tubular bracket members 20 being conventionally attached to the housing 12 and having bores extending therethrough and having axes being disposed generally perpendicular to the front and back walls 13,14 thereof. Each of the cable jacks 16 includes a plurality of cable-receiving holes 17 and also includes an annular flange 18 being conventionally disposed about the cable-receiving holes 17 and extending outwardly from the housing 12.

An electrical outlet adapter member 21 includes a housing member 22 having front, back, and side walls 23–25, and also having mounting brackets 26 being conventionally attached to the housing member 22, and further having prongs 27 extending outwardly from the back wall 24 and being removably received in the slots 19 of the base outlet member 11. The electrical outlet adapter member 21 further includes sets of plug-receiving slots 28 being disposed through the front wall 23 thereof, and also includes tubular support members 29 being conventionally attached to the housing member 22 and having bores extending therethrough and having axes being disposed generally perpendicular to the front and back walls 23,24 thereof and being connected to the tubular bracket members 20 with fastening members 36.

At least one cable connector 30 for connecting a cable to the cable jacks includes a sleeve 31 being adapted to fit about a portion of a cable 35. The sleeve 31 has a cylindrical front portion 32, a flared intermediate portion 33, and a multiple-sided back portion 34. The flared intermediate portion 33 is flared outwardly from the multiple-sided back portion 34 to the cylindrical front portion 32.

In use, the user attached the base outlet member 11 to the electrical wires and mounts the base outlet member to a wall structure, and then removably attaches the electrical outlet adapter member 21 to the base outlet member 11 with power cord from appliances and electronics can be plugged into the electrical outlet adapter member. Also, cable 35 can be plugged into the base outlet member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical wall outlet assembly comprising:

a base outlet member including:

a housing having front, back, and side walls, cable jacks being disposed in at least one of said side walls thereof, said cable jacks including an input cable jack and an output cable jack, each of said cable jacks having a plurality of cable-receiving holes, and slots being disposed through said front wall thereof, each of said slots being in electrical communication with one of said cable-receiving holes,;

an electrical outlet adapter member removably mountable on said base outlet member, said electrical outlet member including:

a housing member having a front, back, and side walls, said housing member having mounting brackets being attached thereto, the front wall having at least one set of plug receiving slots adapted for receiving an electrical plug; and prongs extending outwardly from said back wall and being removably received in said slots of said base outlet member; and at least one cable connector for connecting a cable to said cable jacks;

wherein said slots in said front wall of said housing of said base outlet member having a different shape than said plug receiving slots in said front wall of said housing of said electrical outlet adapter member so that a plug cannot be inserted into the slots of said base outlet member.

2. An electrical wall outlet assembly as described in claim 1, wherein said base outlet member also includes tubular bracket members being attached to said housing and having bores extending therethrough and having axes being disposed generally perpendicular to said front and back walls thereof.

3. An electrical wall outlet assembly as described in claim 1, wherein each of said cable jacks includes an annular flange disposed about said cable-receiving holes and extending outwardly from said housing.

4. An electrical wall outlet assembly as described in claim 2, wherein said electrical outlet adapter member further includes tubular support members being attached to said housing member and having bores extending therethrough and having axes being disposed generally perpendicular to said front and back walls thereof and being connected to said tubular bracket members with fastening members, said tubular support members of said electrical outlet adapter member being axially alignable with said tubular bracket members of said base outlet member when said electrical outlet adapter member is removably mounted on said base outlet member.

5. An electrical wall outlet assembly as described in claim 1, wherein said at least one cable connector includes a sleeve being adapted to fit about a portion of a cable, said sleeve having a cylindrical front portion, a flared intermediate portion, and a multiple-sided back portion, said flared intermediate portion being flared outwardly from said multiple-sided back portion to said cylindrical front portion.

6. An electrical wall outlet assembly as described in claim 1, wherein said slots of said front wall of said housing of said base outlet member each have a circular opening in said front wall to prevent spade terminals of a plug to be inserted therein.

7. An electrical wall outlet assembly as described in claim 6, wherein each of said prongs extending from said housing member of said electrical outlet adapter member have a substantially cylindrical exterior adapted for removable insertion into said slots of said front wall of said housing of said base outlet member.

8. An electrical wall outlet assembly as described in claim 7, wherein said at least one set of plug receiving slots of said front wall of said housing member of said electrical outlet adapter member include substantially rectangular slots being adapted to receive spade terminals of a plug.

9. An electrical wall outlet assembly comprising:

a base outlet member including:

a housing having front, back, and side walls, cable jacks being disposed in at least one of said side walls thereof, said cable jacks including an input cable jack and an output cable jack, each of said cable jacks having a plurality of cable-receiving holes, and slots being disposed through said front wall thereof, each of said slots being in electrical communication with one of said cable-receiving holes:

an electrical outlet adapter member removably mountable on said base outlet member, said electrical outlet member including:

a housing member having a front, back, and side walls, said housing member having mounting brackets being attached thereto, the front wall having at least one set of plug receiving slots adapted for receiving an electrical plug; and prongs extending outwardly from said back wall and being removably received in said slots of said base outlet member; and at least one cable connector for connecting a cable to said cable jacks;

wherein said slots in said front wall of said housing of said base outlet member having a different shape than said plug receiving slots in said front wall of said housing of said electrical outlet adapter member so that a plug cannot be inserted into the slots of said base outlet member;

wherein said base outlet member also includes tubular bracket members being attached to said housing and having bores extending therethrough and having axes being disposed generally perpendicular to said front and back walls thereof;

wherein each of said cable jacks includes an annular flange disposed about said cable-receiving holes and extending outwardly from said housing;

wherein said electrical outlet adapter member further includes tubular support members being attached to said housing member and having bores extending therethrough and having axes being disposed generally perpendicular to said front and back walls thereof and being connected to said tubular bracket members with fastening members, said tubular support members of said electrical outlet adapter member being axially alignable with said tubular bracket members of said base outlet member when said electrical outlet adapter member is removably mounted on said base outlet member;

wherein said at least one cable connector includes a sleeve being adapted to fit about a portion of a cable, said sleeve having a cylindrical front portion, a flared intermediate portion, and a multiple-sided back portion, said flared intermediate portion being flared outwardly from said multiple-sided back portion to said cylindrical front portion;

wherein said slots of said front wall of said housing of said base outlet member each have a circular opening in said front wall to prevent spade terminals of a plug to be inserted therein;

wherein each of said prongs extending from said housing member of said electrical outlet adapter member have a substantially cylindrical exterior adapted for removable insertion into said slots of said front wall of said housing of said base outlet member; and wherein said at least one set of plug receiving slots of said front wall of said housing member of said electrical outlet adapter member include substantially rectangular slots being adapted to receive spade terminals of a plug.

* * * * *